US009687406B1

(12) United States Patent
Steiner

(10) Patent No.: US 9,687,406 B1
(45) Date of Patent: Jun. 27, 2017

(54) STRETCHING DEVICE

(71) Applicant: Gerald M. Steiner, Pahrump, NV (US)

(72) Inventor: Gerald M. Steiner, Pahrump, NV (US)

( * ) Notice: Subject to any disclaimer, the term of this patent is extended or adjusted under 35 U.S.C. 154(b) by 0 days.

(21) Appl. No.: 15/044,946

(22) Filed: Feb. 16, 2016

(51) Int. Cl.
*A63B 26/00* (2006.01)
*A61H 1/02* (2006.01)
*A63B 23/02* (2006.01)
*A63B 23/00* (2006.01)

(52) U.S. Cl.
CPC ..... *A61H 1/0218* (2013.01); *A63B 23/0238* (2013.01); *A63B 2023/006* (2013.01)

(58) Field of Classification Search
CPC ..... A63B 21/4027–21/4039; A63B 21/02–21/028; A63B 21/055–21/0558; A63B 21/045; A63B 21/0455; A63B 23/0233–23/238; A63B 23/006
USPC ..... 482/92, 93, 121–130, 133–134, 142–145
See application file for complete search history.

(56) References Cited

U.S. PATENT DOCUMENTS 3,572,701 A * 3/1971 Agamian ..... A63B 22/203 482/132
3,589,720 A * 6/1971 Agamian ..... A63B 21/012 310/69
3,672,361 A * 6/1972 Fourneron ..... A63B 21/0023 482/132
4,445,684 A * 5/1984 Ruff ..... A61H 1/0244 482/131
4,456,247 A * 6/1984 Ehrenfried ..... A61H 1/0244 482/131
4,608,969 A * 9/1986 Hamlin ..... A61H 1/0218 606/241
4,700,696 A * 10/1987 Schoffstall ..... A61H 1/0218 280/613
4,815,732 A * 3/1989 Mahvi ..... A63B 23/0482 297/115
4,867,143 A * 9/1989 Morin ..... A61H 1/0218 482/144
4,930,769 A * 6/1990 Nenoff ..... A63B 21/068 482/142
5,052,378 A * 10/1991 Chitwood ..... A61H 1/0222 606/242
5,147,266 A * 9/1992 Ricard ..... A61H 1/0244 482/131

(Continued)

*Primary Examiner* — Stephen R. Crow
*Assistant Examiner* — Garrett Atkinson
(74) *Attorney, Agent, or Firm* — The Thornton Firm, LLC

(57) ABSTRACT

A stretching device comprises a rectangular frame including two parallel longitudinal support sleeves, two parallel stretch sleeves fitted to slide into and from said parallel longitudinal support sleeves, two cross members perpendicularly and fixedly connecting the two said parallel longitudinal support sleeves; a foot grip assembly including two foot L-shaped foot grips attached perpendicularly to the distal ends of the longitudinal stretch sleeves; a mechanically ratcheting grip and push rod assembly including two upper push rod sleeves, two lower push rod sleeves, two push rods which slide inside the upper and lower push rod sleeves, two handles with trigger-style levers and quick release buttons, and ratcheting mechanisms to extend the push rods and hold said push rods in place; two U-shaped armpit grips with padding at the distal ends, a rotating connector that attaches the armpit grips to the upper push rod sleeves and the longitudinal support sleeves.

5 Claims, 4 Drawing Sheets

(56) References Cited

U.S. PATENT DOCUMENTS 5,295,935 A * 3/1994 Wang ..... A63B 21/0552 482/123
5,421,801 A * 6/1995 Davies, III ..... A61H 1/0244 482/131
5,518,483 A * 5/1996 Oswald ..... A63B 21/012 482/114
5,518,487 A * 5/1996 Hallmark ..... A63B 23/0211 482/140
5,529,560 A * 6/1996 Davies, III ..... A61H 1/0244 482/131
6,071,217 A * 6/2000 Barnett ..... A63B 22/205 482/121
6,592,501 B1 * 7/2003 Mayes ..... A61H 1/0222 482/142
6,634,995 B1 * 10/2003 Reed ..... A63B 21/153 482/132
6,656,094 B2 * 12/2003 Rigas ..... A61H 1/0218 482/131
6,814,708 B1 * 11/2004 Jennings ..... A61H 1/0222 482/102
7,004,894 B1 * 2/2006 Trotter ..... A63B 23/02 482/140
7,331,914 B2 * 2/2008 Carlucci ..... A61H 1/0229 482/140
7,722,512 B2 * 5/2010 Liang ..... A63B 21/154 482/130
8,251,880 B2 * 8/2012 Hampton ..... A61H 1/0237 482/131
D691,678 S * 10/2013 Cardillo ..... D21/662
8,663,076 B2 * 3/2014 Chou ..... A63B 23/12 482/142
8,992,393 B2 * 3/2015 Reyes ..... A63B 21/08 482/100
2002/0043544 A1 * 4/2002 Caneba ..... A45C 13/262 224/584
2002/0169057 A1 * 11/2002 Forcillo ..... A63B 21/00181 482/142
2003/0114278 A1 * 6/2003 Rigas ..... A61H 1/0218 482/116
2003/0114280 A1 * 6/2003 Rigas ..... A61H 1/0218 482/123
2005/0054499 A1 * 3/2005 Davies, III ..... A61H 1/0229 482/131
2006/0089239 A1 * 4/2006 Davies, III ..... A61H 1/02 482/91
2007/0089752 A1 * 4/2007 Christensen ..... A61H 1/0218 128/845
2009/0312164 A1 * 12/2009 Placencia ..... A63B 23/0211 482/126
2010/0261589 A1 * 10/2010 Hampton ..... A61H 1/0237 482/131
2011/0160625 A1 * 6/2011 Yefimov ..... A61H 1/0259 601/5
2013/0211297 A1 * 8/2013 Method ..... A61H 1/024 601/34

* cited by examiner

STRETCHING DEVICE

CROSS-REFERENCE TO RELATED APPLICATIONS

Not applicable.

RELATED CO-PENDING U.S. PATENT APPLICATIONS

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

BACKGROUND OF THE INVENTION

1. Field of the Invention

One or more embodiments of the invention generally relate to back and abdominal stretching devices. More particularly, the invention relates to traction devices used in spinal decompression therapy.

2. Description of the Related Art

Back pain is one of the leading causes of disability worldwide, and most people have experienced back pain at least once in their life. Some people are born with one or more spinal disorders, while others develop back problems as a result of aging, injury, poor posture, lack of regular exercise, degenerative disease, or arthritis. One particular source of back pain is intervertebral disc disorder. Intervertebral disc disorder is a condition that involves deterioration, herniation, or other dysfunction of the intervertebral discs. Intervertebral discs play an important role in holding the vertebrae together as well as playing a crucial role as a shock absorber in the spine. As people age, intervertebral discs begin to dehydrate which can ultimately result in deterioration the discs. This deterioration, along with other back injuries, can lead to painful symptoms such as herniation of the discs.

Medical treatment for back pain, particularly intervertebral disc disorder, through surgery or pain medication poses serious risks. Among these risks include infection, anesthesia complications, blood clots, spinal cord injury and pain medication addiction. Furthermore, spinal disc surgery may not be successful in relieving pain. Because of these risks, there exists a need for individuals to treat and reverse the causes of back pain in a less invasive, and less harmful manner.

One such noninvasive treatment for back pain, particularly intervertebral disc disorders, is spinal decompression therapy. The theory behind this therapy is that distractive force, when applied to the spine, can create negative pressure on the intervertebral discs, thus creating an optimal healing environment for bulging, degenerating, or herniated discs. This negative pressure creates an osmotic gradient for nutrients and water to diffuse into and rejuvenate the intervertebral discs. Furthermore, when distractive force is applied to the spine, painful pressure on the spinal nerves is relieved. Moreover, decompression therapy can help stretch and strengthen back and abdominal muscles in order to improve posture. Accordingly, many spinal traction and stretching devices have been designed over the years.

Many individuals seek back pain treatment, particularly treatment for intervertebral disc disorders, from chiropractors. Typically, chiropractors perform spinal decompression therapy through the use of traction tables. A patient can lie either supine or prone on a traction table, is secured to the table, and the lower end of the table is mechanically pulled apart from the upper end. This distraction therapy generally consists of several treatments. In theory, each treatment should last 30 to 45 minutes in order for water, oxygen and nutrient-rich fluids to diffuse into the intervertebral discs. Furthermore, this gentile stretching of the spine allows for the retraction of bulging or herniated discs, thus taking pressure off of nerves and other spinal structures.

A general disadvantage of chiropractic treatment is that it involves numerous visits to a practitioner's office. These treatments can be costly, and can pose time constraints on a patient. In addition, most chiropractic tables are unable to be operated by an individual user. Finally, chiropractic traction tables are typically large, very expensive and difficult to store.

A popular alternative to chiropractic spinal traction is known as inversion therapy. Inversion therapy essentially involves a participant hanging upside down. Typically, a participant lies down supine on an inversion table, secures his or her ankles into a brace, and is rotated from a horizontal to a vertical position where the user hangs upside down from his or her feet. The spine is stretched through gravity; primarily by the force of gravity acting on a hanging person's upper torso. Like chiropractic spinal decompression therapy, inversion therapy takes gravitational pressure off the nerve roots and disks in the spine and increases the space between vertebrae.

For many users, though, inversion therapy is intimidating. Furthermore, inversion therapy may result in serious injury. For example, if a user's ankles are not securely fastened into the ankle brace while inverted, injury can result from the user's slipping out of the ankle brace. Additionally, inversion therapy is not recommended for use by anyone with high blood pressure, heart disease or glaucoma; as inversion therapy will increase blood pressure in the upper body by simple gravity. Furthermore, most people are unable to hang upside down for more than a few minutes at a time, which greatly limits the amount of time distractive force is applied, thus diminishing the effectiveness of spinal decompression therapy. Finally, inversion tables are large and not easily storable.

Exercise equipment has also been developed for stretching the back and spinal column. However, few machines exist for the purpose of spinal decompression therapy. These machines tend to be large, heavy and difficult to move. Such exercise equipment is also difficult to disassemble and store. Furthermore, exercise machines have a relatively limited number of adjustments, with certain parts only able to move in limited directions. Moreover, the mechanisms used to for stretching use awkwardly situated lever mechanisms which may be too difficult for a person with back pain to use.

For the foregoing reasons, there is a need for a stretching device that is affordable, is portable, can be easily operated, is less intimidating to use, produces fewer adverse side effects, and can be easily stored.

SUMMARY

The invention is directed to a stretching device that satisfies the need for a stretching device that is affordable, is portable, can be easily operated, is less intimidating to use, produces fewer adverse side effects, and can be easily stored. The exemplary stretching device is effective for treating a variety of spinal or back conditions such as, but not limited to, herniated and bulging discs, sciatica, muscle spasms, spinal stenosis, degenerative disc disease, poor posture, worn spinal joints and injured or diseased spinal nerve roots.

The exemplary stretching device comprises a rectangular frame including two longitudinal support sleeves, two longitudinal stretch sleeves fitted to slide into and from the longitudinal support sleeves, two cross members fixedly connecting the two longitudinal support sleeves at right angles, an axle assembly including a sleeve, axle and padded outer layer connecting the distal ends of the longitudinal stretch sleeves with two wheels attached to the outer ends of the axle assembly, two padded hand grips located at the opposite end of the longitudinal support sleeve from the axle assembly; a foot grip assembly including two L-shaped foot grips attached perpendicularly to the distal ends of the longitudinal stretch sleeves and perpendicular to the axle assembly; a mechanically ratcheting grip and push rod assembly including two upper push rod sleeves, two lower push rod sleeves, two push rods that slide inside the upper and lower push rod sleeves, two ergonomically shaped handles with trigger-style levers and quick release buttons, and ratcheting mechanisms to extend the push rods and hold the pushrods in place when pressure is released from the trigger-style levers; two armpit grips in a U-shaped configuration with padding at the distal ends, a rotating connector that attaches the armpit grips to the upper push rod sleeves and the longitudinal support sleeves.

Spinal decompression therapy and back and abdominal muscle stretching is achieved through the user engaging the trigger-style levers which drive the push rods longitudinally towards the foot grip assembly. This driving of the push rods slides the longitudinal stretch sleeves out of the longitudinal support sleeves, moving the foot grip section away from the armpit grip section. In turn, this distraction of the device thus applies a gentile and adjustable stretching force on the spinal column.

BRIEF DESCRIPTION OF THE DRAWINGS

The invention is illustrated by way of example, and not by way of limitation, in the figures of the accompanying drawings and in which like reference numerals refer to similar elements and in which.

Figure 1:
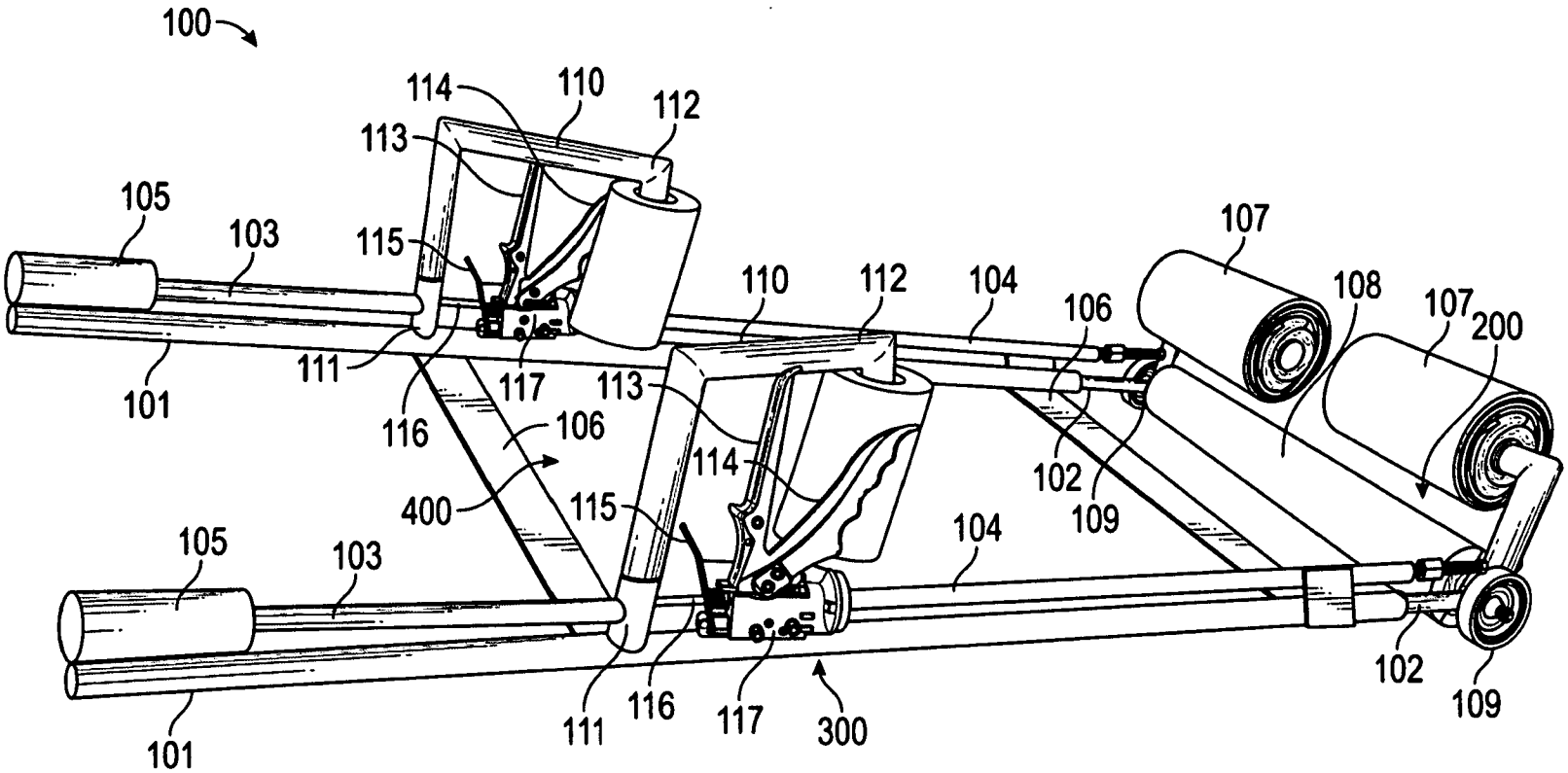
FIG. 1 illustrates a perspective view of an exemplary stretching device in accordance with an embodiment of the invention.

Unless otherwise indicated illustrations in the figures are not necessarily drawn to scale.

DETAILED DESCRIPTION OF THE PREFERRED EMBODIMENTS

Terminology used herein is used for the purpose of describing particular embodiments only, and is not intended to limit the scope of the present invention. It must be understood that as used herein and in the appended claims, the singular forms "a," "an," and "the" include the plural reference unless the context clearly dictates otherwise. For example, a reference to "an element" is a reference to one or more elements and includes all equivalents known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Language that may be construed to express approximation should be so understood unless the context clearly dictates otherwise.

Unless defined otherwise, all technical and scientific terms used herein have the same meanings as commonly understood by a person of ordinary skill in the art to which this invention belongs. Preferred methods, techniques, devices, and materials are described. But any methods, techniques, devices, or materials similar or equivalent to those described herein may be used in the practice or testing of the present invention. Structures described herein should also be understood to refer to functional equivalents of such structures.

References to "one embodiment," "an embodiment," "various embodiments," etc., may indicate that the embodiment(s) of the invention so described may include particular features, structures, or characteristics. However, not every embodiment necessarily includes the particular features, structures, or characteristics. Further, repeated use of the phrase "in one embodiment," or "in an exemplary embodiment," do not necessarily refer to the same embodiment although they may. A description of an embodiment with several components in communication with each other does not imply that all such components are required. On the contrary, a variety of optional components are described to illustrate the wide variety of possible embodiments of the present invention.

As is well known to those skilled in the art, many careful considerations and compromises typically must be made when designing for the optimal manufacture of a commercial implementation of such a stretching device. A commercial implementation in accordance with the spirit and teachings of the invention may be configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art.

The stretching device will now be described in detail with reference to embodiments thereof as illustrated in the accompanying drawings.

FIG. 1 illustrates a detailed perspective view of an exemplary stretching machine in accordance with an embodiment of the invention. The machine is divided into four primary components: A rectangular frame 100, a foot grip assembly 200, a mechanically ratcheting grip and push rod assembly 300 and the upper torso armpit grip assembly 400. In this view, the armpit grip assembly's armpit grips are positioned in a lowered, and storable, configuration.

In one embodiment of the invention, the exemplary stretching device may include two longitudinal support sleeves 101, two longitudinal stretch sleeves 102 fitted to slide into and from the support sleeves, two cross members 106 fixedly connecting the two longitudinal support sleeves 101 at right angles, two upper push rod sleeves 103, two lower push rod sleeves 104, two padded handles located at the proximal end of the upper support sleeve 105, two padded foot racks 107, an axle assembly 108, two wheels mounted at each end of the axle assembly 109, two armpit grips 110 in a U-shaped configuration with padding surrounding distal ends 112, a fitting 111 used to attach the proximal ends of the U-shaped armpit grips 110 to the upper push rod sleeves 103 and the longitudinal support sleeves 101, two push rods 116 which slide inside the upper 103 and lower 104 push rod sleeves, handles 113 with trigger-style levers 114 and quick release buttons 115, and mechanically ratcheting grip mechanisms 117 to extend the push rods 116. The mechanically ratcheting grip mechanisms 117 may be fixedly attached to the longitudinal support sleeves 101 and the lower push rod sleeves 104. The frame may include the two longitudinal support sleeves 101 fixedly connected by the two cross members 106 at right angles. The support sleeves and cross members may be made from, but not limited to, steel, in order to provide for a rigid frame capable of supporting a person's weight. One such means of connecting the parts of the frame is through welds, though other means of fixedly connecting parts are possible. Other means of connecting parts of the frame, foot grip assembly, mechanically ratcheting grip and push rod assembly, and the armpit grip assembly could include bolts and threaded holes in order to provide for simple assembly and disassembly.

Figure 2:
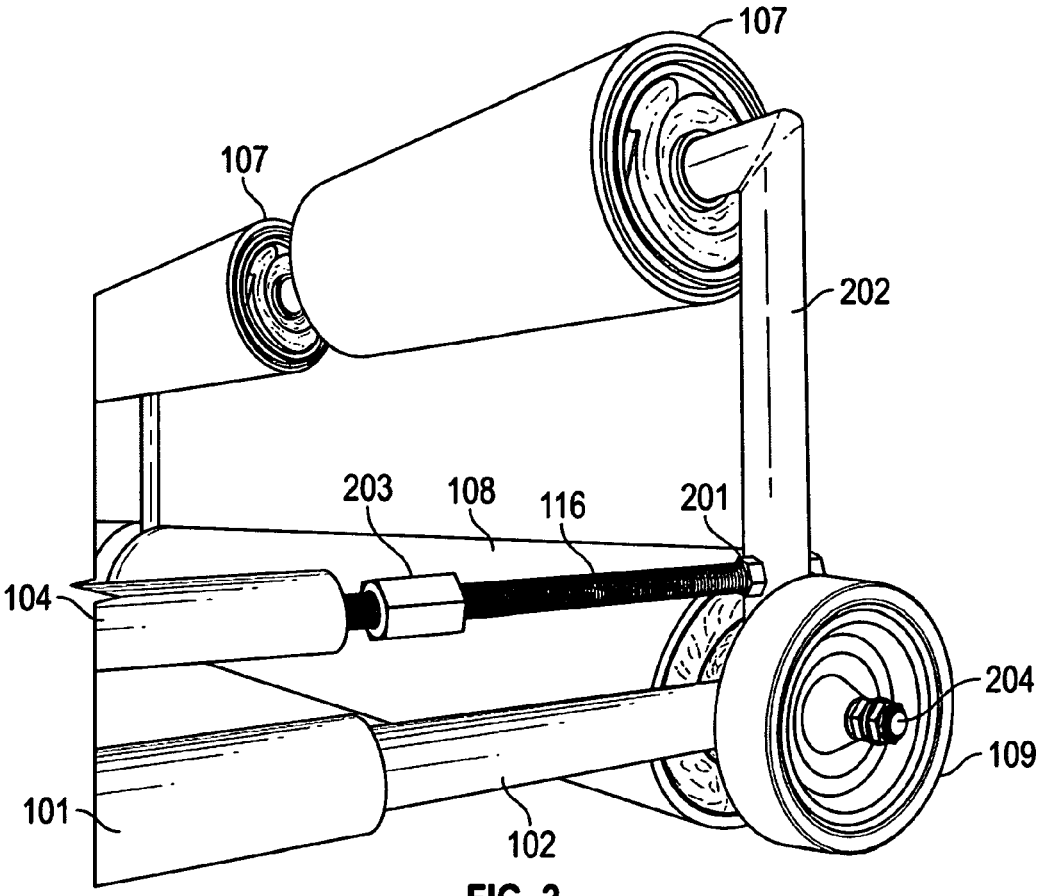
FIG. 2 illustrates a perspective view of an exemplary stretching device's foot grip assembly in accordance with an embodiment of the invention.

FIG. 2 illustrates a perspective view of an exemplary stretching device's foot grip assembly 200 in accordance with an embodiment of the invention. In this embodiment, the longitudinal stretch sleeves may slide 102 into the longitudinal support sleeves 101. The longitudinal stretch sleeves may be fixedly connected by an axle assembly 108. The axle assembly 108 may include an internal axle, a sleeve and padded outer layer. The axle assembly's sleeve may be fixedly attached to the distal ends of the longitudinal stretch sleeves 104 with the internal axle positioned rotatably inside the sleeve. The internal axle may extend through the distal ends of the longitudinal stretch sleeves 102. Wheels 109 may be mounted by on the ends of the axle assembly 108 on the outside longitudinal stretch sleeves 101. These wheels may serve a dual purpose: The wheels may firstly assist in the distraction of the longitudinal support and stretch sleeves by enabling the foot grip assembly to roll longitudinally when force is applied to the foot grip assembly from the push rod 116, and secondly may serve as a means of moving the exemplary stretching device from one location to another.

In one embodiment of the exemplary stretching device, the longitudinal support sleeves may be arranged parallel to one another being fixedly connected by two cross members 106 and the axle assembly 108. Situated parallel to, and directly above, or superior to, the longitudinal support sleeve 101 and the longitudinal stretch sleeve 102 is the upper push rod sleeve 103, the push rod 116, and the lower push rod sleeve 104. The push rod 116 may connect perpendicularly to the foot grip bracket 202. The end of the push rod may be threaded so as to connect to the foot grip bracket 202 by screw action 201. The longitudinal length of the push rod assembly, and ultimately the stretching device, can be regulated by a nut 203. In another embodiment, the push rods 116 may be welded to the bracket. The foot grip brackets 202 are fixedly and perpendicularly attached to the longitudinal stretch sleeves. Further, the L-shaped foot grip brackets are fixedly positioned so as to form a right angle with the axle assembly at the proximal end and run parallel with the axle assembly at the distal end. The foot grip assembly may include an upper foot grip 107 and a padded lower foot grip 108 that also doubles as an axle assembly.

Figure 3:
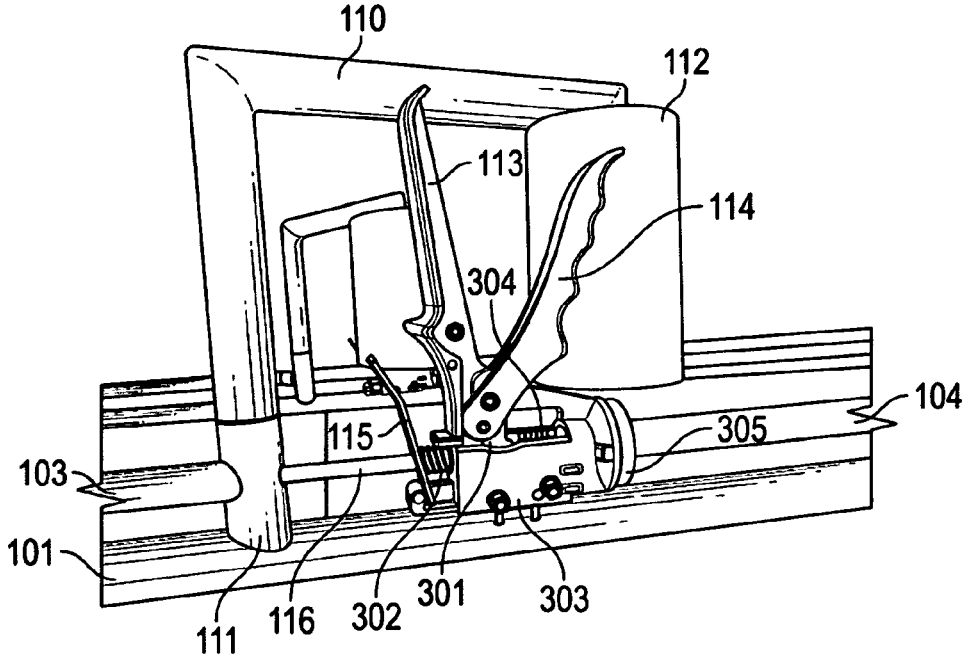
FIG. 3 illustrates a side view of an exemplary stretching device's mechanical grip and push rod assembly in accordance with an embodiment of the invention.

FIG. 3 illustrates a perspective view of an exemplary stretching device's mechanical grip and push rod assembly 300 in accordance with an embodiment of the invention. In one embodiment, the mechanism for driving the push rod towards the foot grip assembly may be a smooth rod ratcheting mechanism wherein a push rod 116 may be driven by a lever 114 with a driving element 304 located where the end of the lever comes in contact with the push rod 116. When the lever mechanism is engaged, the driving element then comes in contact with the push rod where it is driven longitudinally by the lever mechanism. It will become readily apparent to persons having skill in the art that such a driving element can be made from many different materials and can be shaped in many ways in order to provide effective longitudinal movement of the push rod. In one such embodiment, the driving element is a rubber tip shaped to conform to the push rod when the lever mechanism comes in contact with the push rod. The push rod 116 may be held in a fixed alignment by slidingly fitting in the upper 103 and lower 104 push rod sleeves. The push rod may be further held in a fixed alignment by the ratcheting assembly's housing 303. Persons having skill in the art will recognize that many adjustments and additions to the housing can be added to facilitate in the movement and fixation of the push rod. The upper push rod sleeve 103 may be fixedly connected to the fitting 111 with the trigger assembly fixedly connected to the lower push rod sleeve by a jointing section 305. The push rod 116 may be longitudinally held in place through the use of a spring-loaded pressure bar lock plate 302. When gripping pressure is applied to the trigger-style hand grips, the pressure bar lock 302 plate may be released slightly to allow the push rod to move longitudinally. Those skilled in the art will readily appreciate that such a smooth rod ratcheting mechanism requires less gripping force to move the push rod than traditional lever, gear, pawl and grooved push rod ratcheting mechanisms. It will further become readily apparent to persons skilled in the art that there are numerous ways to ergonomically configure the hand grip 113 and lever 114 of such an assembly. The push rod may be released, allowing it to return to its original longitudinal position, by applying pressure to the quick release lever on the opposite end of the pressure bar 115 to return the stretching device back to its original position. The armpit grip assembly 110 may be rotatably connected to the fitting 111 at a right angle to the upper push rod support sleeve.

Those skilled in the art will recognize that other ways of achieving the adjustment of the stretching device's longitudinal length are available. For example, and without limitation, alternative embodiments may incorporate a linear ratcheting mechanism employing a traditional lever, gear, pawl and grooved push rod assembly. In other embodiments, an electric motor and linear actuator may be used to move the push rods.

Figure 4A:
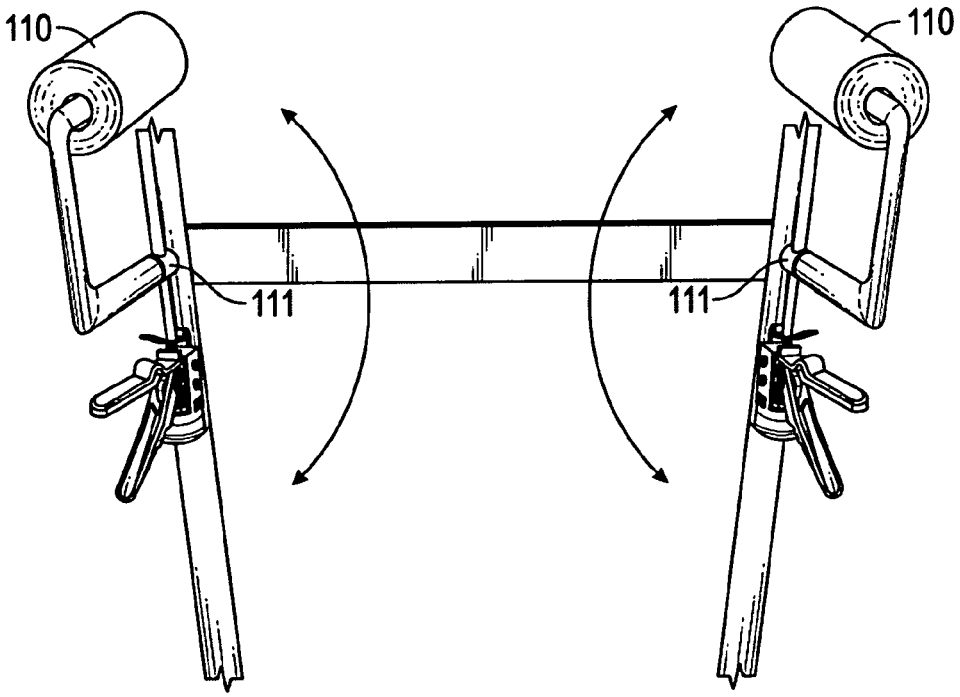
FIG. 4A illustrates a top view of an exemplary stretching device's armpit grip assemblies and the hand grip assemblies in accordance with an embodiment of the invention.
Figure 4B:
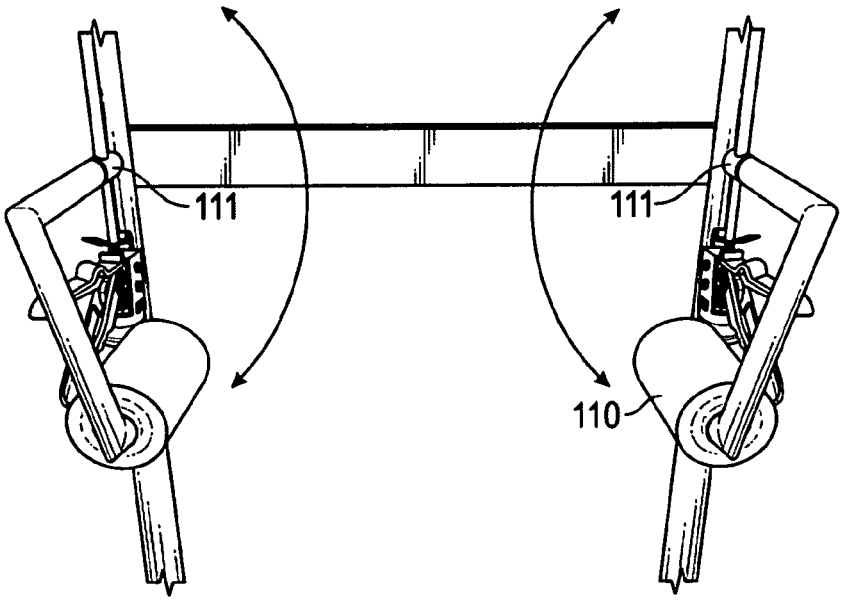
FIG. 4B illustrates a top view of an exemplary stretching device's armpit grip assemblies and the hand grip assemblies in accordance with an embodiment of the invention.

FIG. 4A and FIG. 4B illustrate a top perspective view of an exemplary stretching device's armpit grip assembly and handles with trigger-style levers 400 in accordance with an embodiment of the invention. The proximal end of each U-shaped armpit grip may be rotatably attached into a fitting 111 which allows the armpit grip assembly to rotate 180 degrees. The fitting 111 may include a nylon male/female rotating sleeve assembly for use in rotating. Alternatively, the fitting may include a roller or ball bearing assembly. Persons skilled in the art will recognize that other ways of rotatably attaching the armpit grips to the frame may be used. In one embodiment of the invention, the armpit grips 110 rotate to rest in the user's underarms depending on the user's shoulder width. FIG. 4A illustrates the exemplary stretching device with the armpit grips in a position ready to use. FIG. 4B illustrates the exemplary stretching device with the armpit grips in a storable position. The device's longitudinal length may be adjusted through the mechanical grip and push rod assembly 300 as explained above. When the user is securely positioned in the device, the user then finds his or her most comfortable personal stretch length through engaging the mechanically ratcheting grip mechanism, the user may then proceed to add additional distractive force through engaging the mechanical grips.

Figure 5:
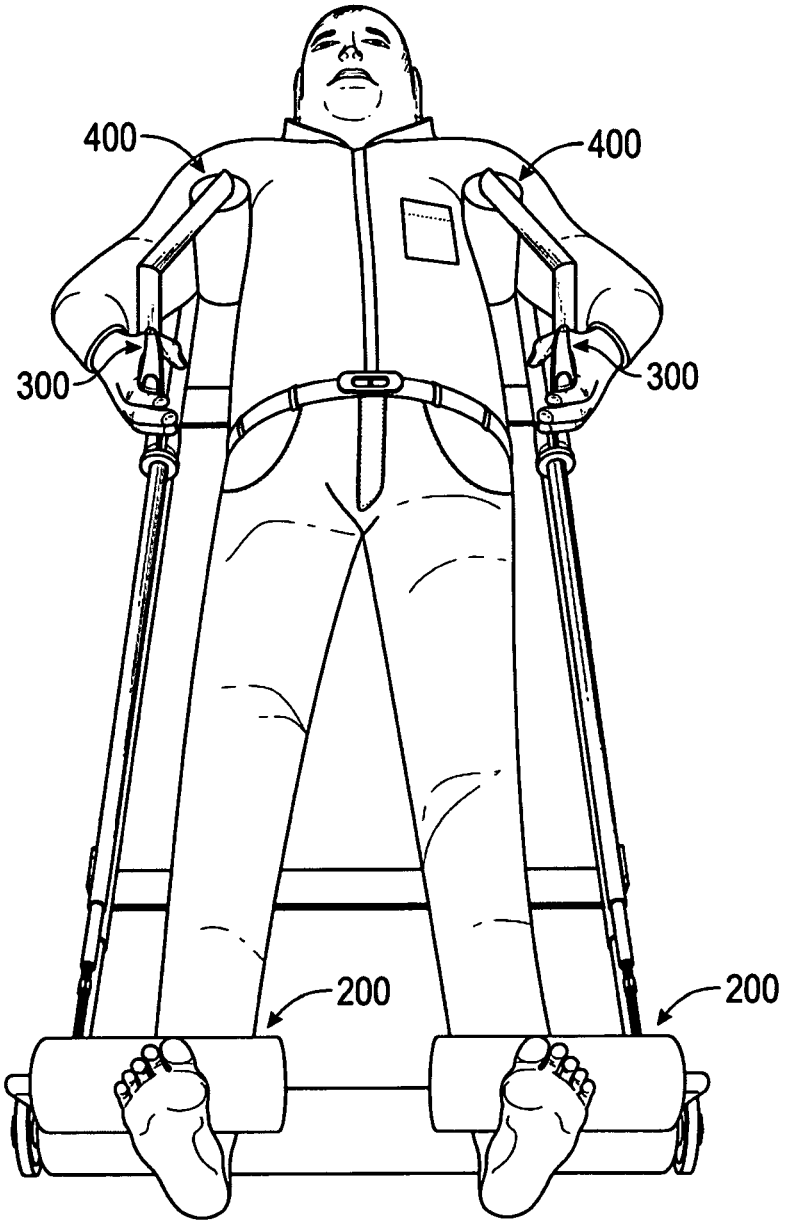
FIG. 5 illustrates a person using an exemplary stretching machine in accordance with an embodiment of the invention.

FIG. 5 illustrates a person using the exemplary stretching device in accordance with an embodiment of the invention. In an embodiment of the invention, the exemplary stretching device may be laid flat on a surface such as the ground, a table or on a bed. The user may then lay supine between the parallel sleeves, placing his or her feet in the foot grips. This may be achieved by the user sliding each ankle into the foot grip assembly 200. The user may then secure his or her upper body through rotation of the armpit wings so as to fit the padded ends under his or her arm in the armpit area 400. By doing so, the user may securely hold his or her upper body in place. The user may then proceed to applying gripping pressure to the two trigger-style grips 300 which longitudinally extend the push rods. When extending, the push rods then force the bottom longitudinal stretch sleeves outward which is assisted through the wheels positioned at the distal end of the bottom longitudinal stretch sleeve. This longitudinal stretching may ultimately lengthen the device while the user's upper body and ankles remain fixed, thus applying a distracting force on the spine. The user may then remain in the stretched position for the recommended therapeutic time.

Embodiments of the invention may be usable by persons of heights between 5 feet three inches and 6 feet five inches with a weight range between 100 and 300 pounds. However, it will become apparent to those skilled in the art that simple adjustments could be made to the device to accommodate persons of even greater ranges of height and weight.

An alternative embodiment of the invention may involve mechanical grip and push rod assembly integrated into the rectangular frame. In such embodiment, the armpit wings would be hingedly attached to the frame with the foot grip and wheel assembly attached to the distal end of the frame. Such an embodiment would eliminate the need for the upper and lower push rod sleeves. In such an embodiment, slightly larger diameters for the longitudinal support and stretch sleeves could be used with the push rod assemblies running inside the frame and fixedly attached to the foot grip assembly. The ergonomically configured handgrips could be positioned so as to be outside the frame. Such an embodiment would have increased portability and would be greater optimized for storage in a closet or under a bed. Another embodiment may have an outer shroud surrounding the rectangular frame so as to provide additional support and offer a simpler appearance.

In another embodiment of the invention, a support assembly is attached to the foot grip assembly end of the frame enabling the user of the invention to use the device in a standing position as opposed to a supine position. Persons skilled in the art will recognize that there are many ways in which this could be accomplished. One such way would be to hingedly attach foldable stands or struts to the distal ends of the longitudinal stretch sleeves. Another such way would be to hingedly attach foldable stands or struts to the foot grip assembly. Such stands or struts would allow the stretching device to freely stand in a vertical position. Persons with disabilities would have less difficulty entering and using the stretching device. When used in a vertical position, the force created by the hand grips and exerted on the distal end of the device would translate to the armpit grip end of the device, particularly to the armpit rests. In such embodiments, decompression therapy could be achieved with less difficulty entering and exiting the device.

In various embodiments of the invention, the user may employ varying types of cushioning or additional back support if desired. In one embodiment of the invention, a cushioned support bench may be attached and removed from the cross members 106. Those skilled in the art will readily appreciate the numerous means in which this could be accomplished. For example, and without limitation, a bench could be attached with simple nuts and bolts. In another embodiment, the user can use custom molded foam padding to support the lumbar curve and achieve a more comfortable and optimized posture. In an alternate embodiment, a neck brace may be attached to the support sleeves and/or the cross members to provide for greater stability and upper back and neck stretching. In another embodiment, a hip brace or pelvic girdle may be attached to provide a user greater support in the pelvic area. In yet another embodiment of the invention, a user may use pillows or cushions to support his or herself while using the stretching device.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Having fully described at least one embodiment of the exemplary stretching device, other equivalent or alternative methods of implementing the stretching device according to the present invention will be apparent to those skilled in the art. Various aspects of the invention have been described above by way of illustration, and the specific embodiments disclosed are not intended to limit the invention to the particular forms disclosed. The particular implementation of the stretching device may vary depending upon the particular context or application. By way of example, and not limitation, the stretching device described in the foregoing was principally directed to spinal decompression therapy implementations. However, similar techniques may instead be applied to back and abdominal muscle stretching and posture modification, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Although specific features of the invention are shown in some drawings and not others, persons skilled in the art will understand that this is for convenience. Each feature may be combined with any or all of the other features in accordance with the invention. The words "including," "comprising," "having," and "with" as used herein are to be interpreted broadly and comprehensively, and are not limited to any physical interconnection. Claim elements and steps herein may have been numbered and/or lettered solely as an aid in readability and understanding. Any such numbering and lettering in itself is not intended to and should not be taken to indicate the ordering of elements and/or steps in the claims.

Any amendment presented during the prosecution of the application for this patent is not a disclaimer of any claim element presented in the description or claims as filed. Persons skilled in the art cannot reasonably be expected to draft a claim that would literally encompass each and every equivalent.

The Abstract is provided to comply with Title 37 of the Code of Federal Regulations, Section 1.72(b) requiring an abstract that will allow and enable the United States Patent and Trademark Office and the public generally to determine quickly from a cursory inspection the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A stretching device comprising:

a rectangular frame including two parallel longitudinal support sleeves, two parallel longitudinal stretch sleeves fitted to slide into and from said longitudinal support sleeves, two cross members perpendicularly and fixedly attached to said parallel longitudinal support sleeves, and an axle assembly including an axle and a padded outer layer with said axle fixedly connecting the distal ends of the said two parallel longitudinal stretch sleeves with wheels attached to the distal ends of said axle;

a foot grip assembly including two L-shaped foot grips perpendicularly attached to the distal ends of each parallel longitudinal stretch sleeve so as to be perpendicular to the longitudinal stretch sleeves and perpendicular to the axle assembly with padding secured around the distal ends of said L-shaped foot grips;

an armpit grip assembly including two U-shaped armpit grips, and a mechanically ratcheting hand grip and push rod assembly employing two ergonomically shaped and configured hand grips with trigger-style ratcheting levers and quick release buttons used to adjust the length of said stretching device.

2. The stretching device as recited in claim 1 wherein said mechanically ratcheting hand grip assembly includes two upper push rod sleeves connected superior and parallel to said longitudinal support sleeves, two lower push rod sleeves connected superior and parallel to said longitudinal support sleeves, two push rods which slide inside said upper and lower push rod sleeves, and two smooth rod ratcheting mechanisms, the said two ergonomically shaped and configured hand grips with trigger-style ratcheting levers used to extend the length of said stretching device fixedly connecting said upper and lower push rod sleeves and positioned superior and running parallel with said longitudinal support sleeves, to extend said push rods and maintain alignment of said push rods.

3. The stretching device as recited in claim 1 wherein said U-shaped armpit grips are rotatably attached at the proximal end of each said U-shaped armpit grip to a fitting which is connected perpendicularly to said longitudinal support sleeves with padding secured around the distal ends of said U-shaped armpit grips.

4. A stretching device consisting essentially of:

a rectangular frame including two parallel longitudinal support sleeves, two parallel longitudinal stretch sleeves fitted to slide into and from said parallel longitudinal support sleeves, two cross members perpendicularly and fixedly connecting the two said parallel longitudinal support sleeves, an axle assembly including a sleeve, an axle, and a padded outer layer connecting the distal ends of said longitudinal stretch sleeves with wheels attached to the outer ends of the axle assembly;

a foot grip assembly including two L-shaped foot grips perpendicularly attached to the distal ends of said longitudinal stretch sleeves and the axle assembly connecting the two distal ends of the longitudinal stretch sleeves wherein padding is secured around the distal ends of said L-shaped foot grips;

an armpit grip assembly including two armpit grips in a U-shaped configuration, a rotating connector that attaches the proximal end of each said armpit grip to the upper push rod sleeves and the longitudinal support sleeves, and padding placed at the distal end of said grips; and a mechanically ratcheting grip and push rod assembly including two upper push rod sleeves connected superior and parallel to said longitudinal support sleeves wherein padding is secured around the distal ends of said upper push rod sleeves opposite to said foot grip assembly, two lower push rod sleeves connected superior and parallel to said longitudinal support sleeves, two push rods which slide inside said upper and lower push rod sleeves, two ergonomically shaped and configured hand grips with trigger-style ratcheting levers and quick release buttons positioned superior to said longitudinal support sleeves and fixedly attached to said longitudinal stretch sleeves, and two smooth rod ratcheting mechanisms with quick release buttons, fixedly connecting said upper and lower push rod sleeves, to extend said push rods and maintain alignment of said push rods.

5. A method for spinal column and muscle stretching, the method comprising:

a user lying supine in the stretching device recited in claim 1; securing his or her feet in the foot grip assembly; securing his or her upper body through rotation of the armpit grips so as to fit the padded ends under his or her arm in the armpit area; grasping the two ergonomically shaped and fitted hand grips; applying gripping pressure to the two ergonomically shaped hand grips with trigger-style levers which longitudinally extend the push rods and apply distractive force on the spine; and maintaining his or her position in the machine while distractive force is being applied for the recommended period of time.

* * * * *